US006612435B1

(12) United States Patent
Chang

(10) Patent No.: US 6,612,435 B1
(45) Date of Patent: Sep. 2, 2003

(54) TOOL CASE

(76) Inventor: Yeh-Ching Chang, No. 180-1, Sec. 2, Changping Rd., Taichung City (TW)

( * ) Notice: Subject to any disclaimer, the term of this patent is extended or adjusted under 35 U.S.C. 154(b) by 0 days.

(21) Appl. No.: 10/377,871

(22) Filed: Mar. 4, 2003

(51) Int. Cl.[7] ..... B65D 85/28
(52) U.S. Cl. ..... 206/373; 206/376; 206/379; 312/902
(58) Field of Search ..... 206/349, 372–379, 206/485; 220/4.29, 212, 524; 312/244, 902

(56) References Cited

U.S. PATENT DOCUMENTS 4,273,394 A * 6/1981 Chandler ..... 206/373
4,285,556 A * 8/1981 Loeffel ..... 312/902
6,068,123 A * 5/2000 Chen ..... 206/373
6,264,030 B1 * 7/2001 Tsou ..... 206/372
6,283,292 B1 * 9/2001 Chen ..... 206/373

* cited by examiner

*Primary Examiner*—Luan K. Bui
(74) *Attorney, Agent, or Firm*—Rabin & Berdo, P.C.

(57) ABSTRACT

A tool case has multiple side plates, a bottom plate, an upper cover and multiple side covers. The side plates are connected with each other to define a containing space for storing large tools. Multiple recesses are defined in the outer side of each respective side plate for receiving tools. Each side cover is pivotally connected to one of the side plates and has an inner side with multiple recesses to receive tools. Accordingly, the space for storing tools in the tool case is large and many, and the use of the tool case is versatile.

7 Claims, 5 Drawing Sheets

TOOL CASE

BACKGROUND OF THE INVENTION

1. Field of the Invention

The present invention relates to a tool case, and more particularly to a tool case which has a large and many storing space for storing different shapes and types of tools.

2. Description of Related Art

To convenient carry tools to a desired location, a tool case is used. A conventional tool case in accordance with the prior art comprises a body and a cover pivotally attached to the body. Multiple recesses are respectively defined in the body and the cover to receive tools.

However, the space for storing tools in the conventional tool case is only defined in corresponding sides of the body and the cover, and the storing space of the conventional tool case is not enough to carry a large amount of tools. In addition, some large tools, such as hammers, pneumatic tools, saws and so on, cannot be stored in the conventional tool case, such that the usage of the conventional tool case is not versatile.

To overcome the shortcomings, the present invention tends to provide a tool case to mitigate or obviate the aforementioned problems.

SUMMARY OF THE INVENTION

The main objective of the invention is to provide a tool case which can contain large tools, such as hammers, pneumatic tools, saws, accessories and so on. The tool case has multiple side plates, a bottom plate, an upper cover and multiple side covers. The side plates are connected with each other to define a containing space for storing large tools. Multiple recesses are defined in the outer side of each respective side plate for receiving tools. Each side cover is pivotally connected to one of the side plates and has an inner side with multiple recesses to receive different shapes and types of tools and accessories. With such a tool case, the space for storing tools in a tool case is large, and the use of the tool case is versatile.

Other objects, advantages and novel features of the invention will become more apparent from the following detailed description when taken in conjunction with the accompanying drawings.

DETAILED DESCRIPTION OF PREFERRED EMBODIMENT

Figure 1:
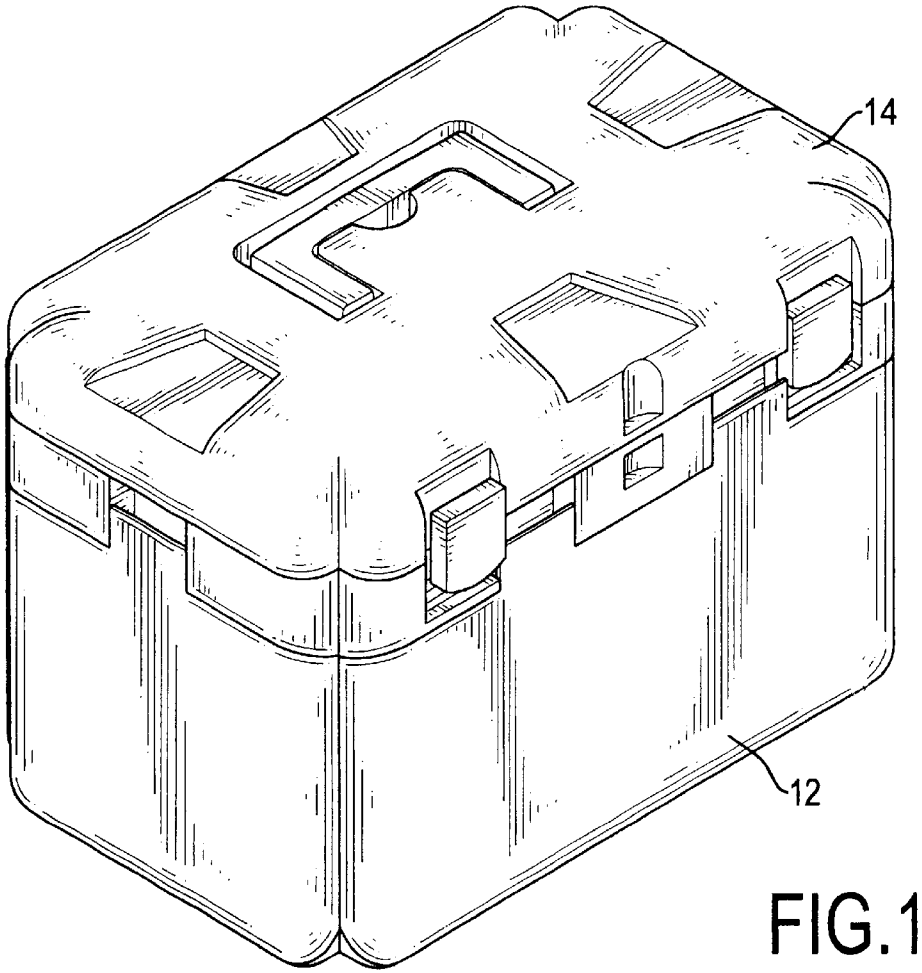
FIG. 1 is a perspective view of a tool case in accordance with the present invention.
Figure 2:
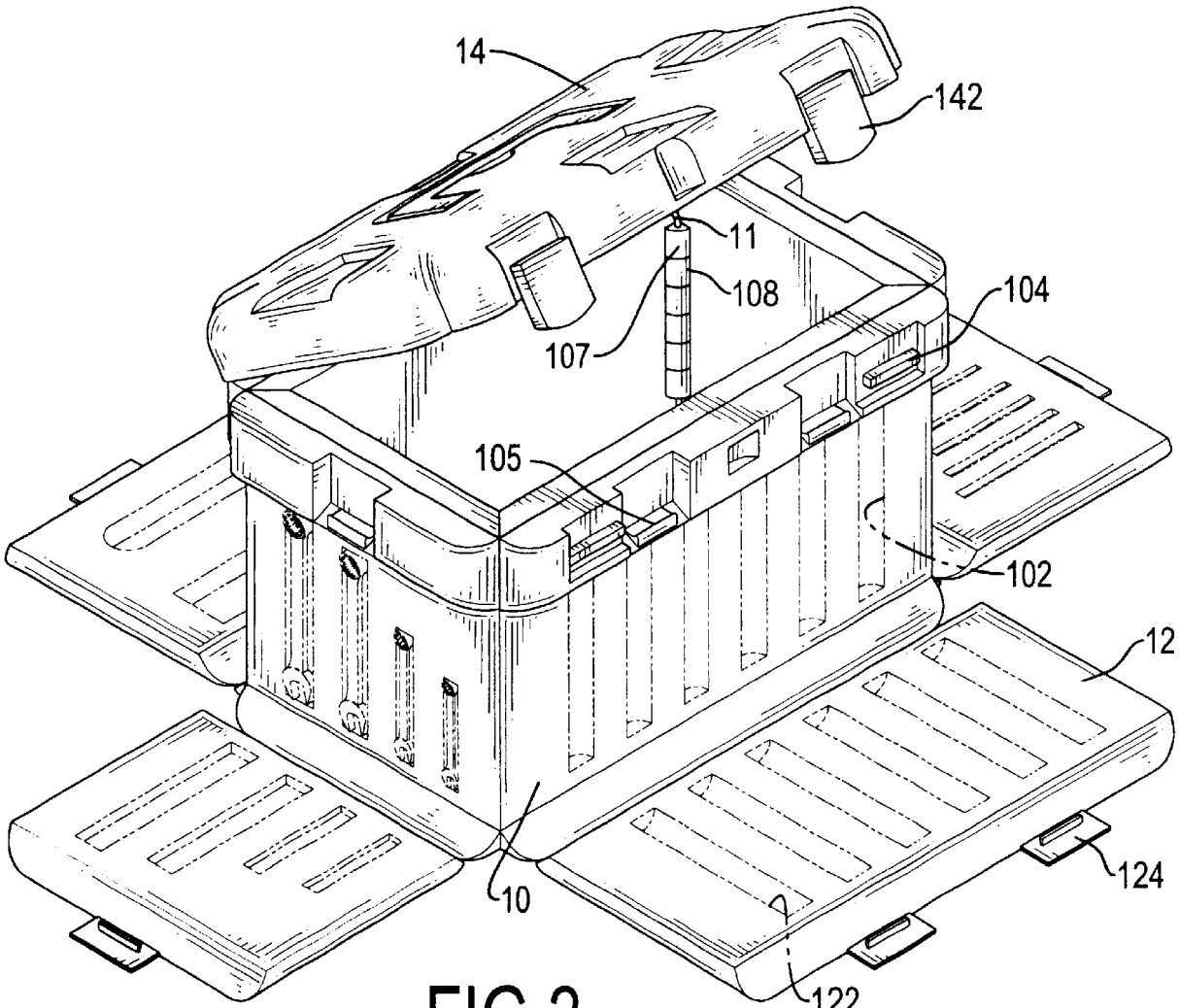
FIG. 2 is a perspective view of the tool case in FIG. 1 showing that the tool case is in an opened condition.
Figure 3:
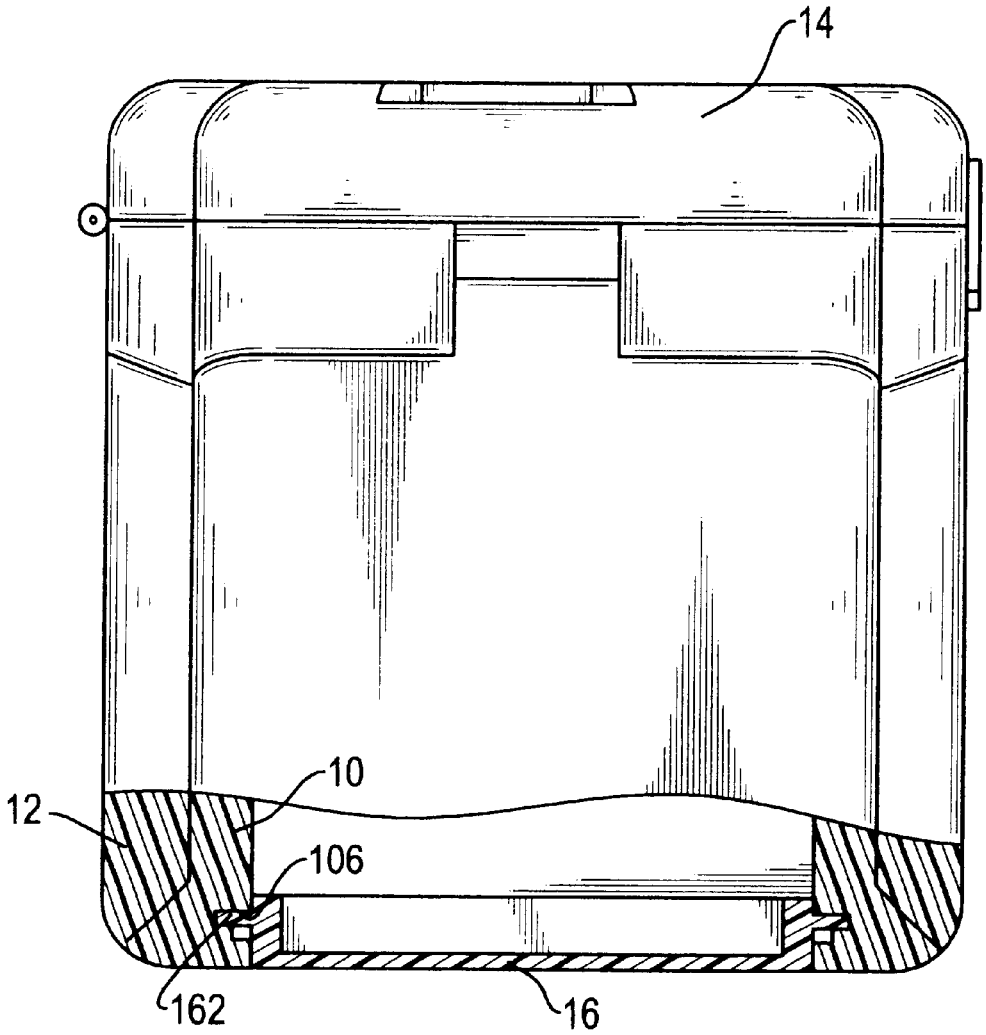
FIG. 3 is a side plan view in partial cross section of the tool case in FIG. 1.

With reference to FIGS. 1 to 3, a tool case in accordance with the present invention comprises multiple side plates (10), a bottom plate (16), an upper cover (14) and multiple side covers (12). Each side plate (10) has an outer side, an inner side and two ends. Two ends of each side plate (10) are respectively connected with adjacent side plates (10) to define a containing space with a top opening and a bottom opening between the inner sides of the side plates (10). Multiple recesses (102) are defined in the outer side of each respective side plate (10) for receiving tools, such as wrenches, bits, drills and so on.

The bottom plate (16) is attached to the side plates to close the bottom opening of the containing space and to hold the tools stored in the containing space. The upper cover (14) is pivotally attached to one of the side plates (10) to close the containing space. An engaging device is mounted between the upper cover(14) and one of the side plates (10) away from the side plate (10) on which the upper cover (14) is mounted. The engaging device comprises at least one knob (105) formed on the side plate (10) corresponding to the upper cover (14) and a first engaging tab (142) extending from the upper cover (14) and corresponding to each respective knob (105). When the upper cover (14) is closed, the first engaging tabs (142) will respectively engage with the corresponding knobs (105) on the side plate (10). With the engagement of the first engaging tabs (142) and knobs (105), the top opening of the containing space is closed with the upper cover (14). This can keep the tools stored in the containing space from escaping from the containing space when the tool case is transported. In addition, a handle (not numbered) is mounted on the upper cover (14), and it is convenient for a user to carry the tool case with the handle.

Each side cover (12) is pivotally connected to one of the side plates (10). In practice, each side cover (12) is pivotally connected to the bottom of the corresponding side plate (10). Each respective side cover (12) has an inner side, facing the corresponding one of the side plates (10), and multiple recesses (122) are defined in the inner side of each side cover (12) to receive tools. An engaging device is mounted between each respective side plate (10) and the corresponding side cover (12). The engaging device has at least one knob (104) formed on the side plate (10) and a second engaging tab (124) extending from the side cover (12) and corresponding to each respective knob (104) to detachably engage with the corresponding knob (104). With the engaging device, the side cover (12) is kept from opening relative to the side plate (10) so as to keep the tools enclosed between the side plate (10) and the corresponding side cover (12).

In such an arrangement, the tools can be selectively stored in the recesses (102,122) in the side plates (10) and the side covers (14). With multiple side plates (10) and side covers (12), the storing spacing of the tool case is large. Additionally, some large tools, such as hammers, pneumatic tools and so on, can be stored in the containing space between the side plates (10). The tool case in accordance with the present invention can be used for storing and for carrying different types of tools, such that the use of the tool case is versatile.

Figure 4:
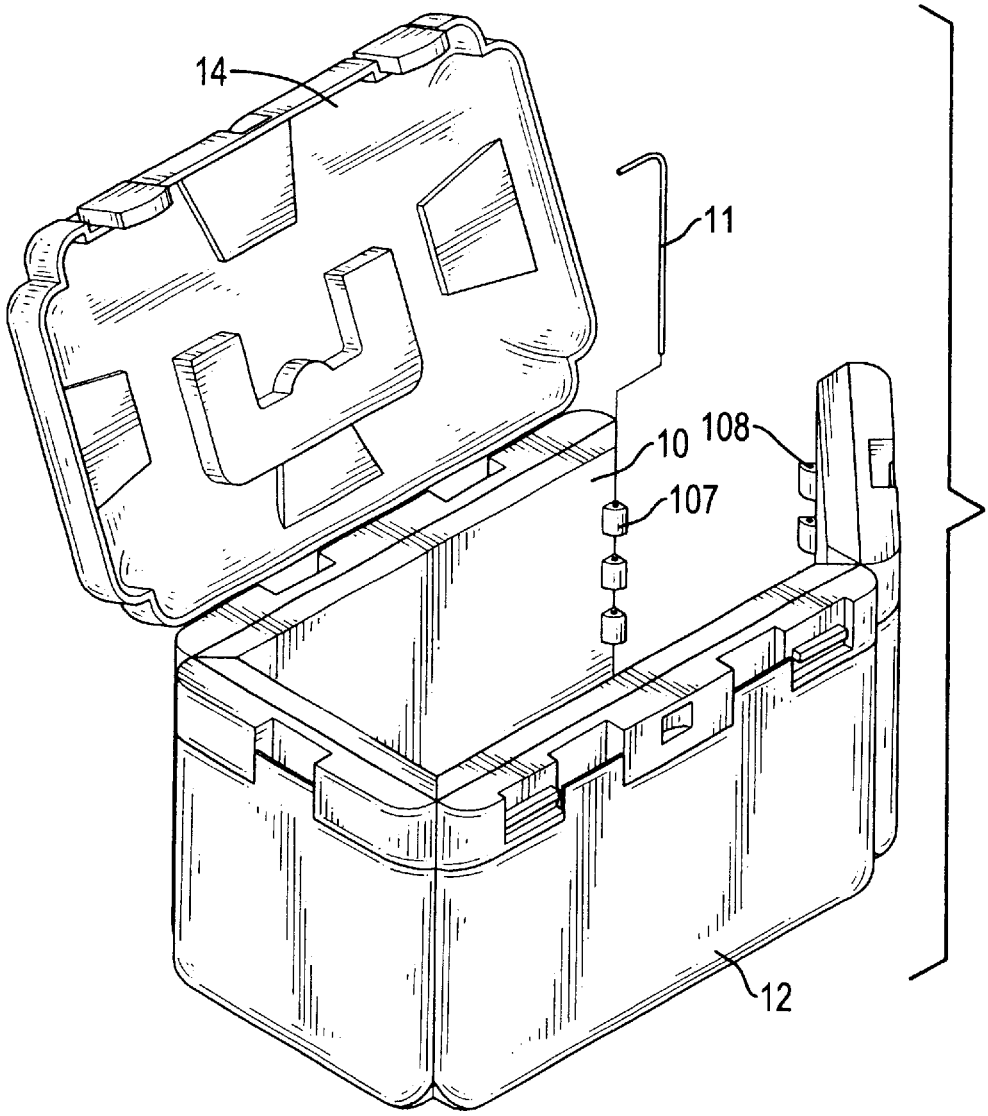
FIG. 4 is an exploded perspective view of the tool case in FIG. 1.

With reference to FIGS. 1 and 4, a detachable connection device is mounted between two of the side plates (10) to make the side plates expandable. The connection device comprises at least one first pivotal block (107), at least one second pivotal block (108) and a pivot pin (11). Each first pivotal block (107) has a pivotal hole and is formed on one of the side plates (10). Each second pivotal block (108) has a pivotal hole, is formed on an adjacent side plate (10) and corresponds to the first pivotal blocks (107). The pivot pin (11) penetrates through the pivotal holes in the pivotal blocks (107,108) so as to pivotally connect the adjacent side plates (10) together.

Figure 5:
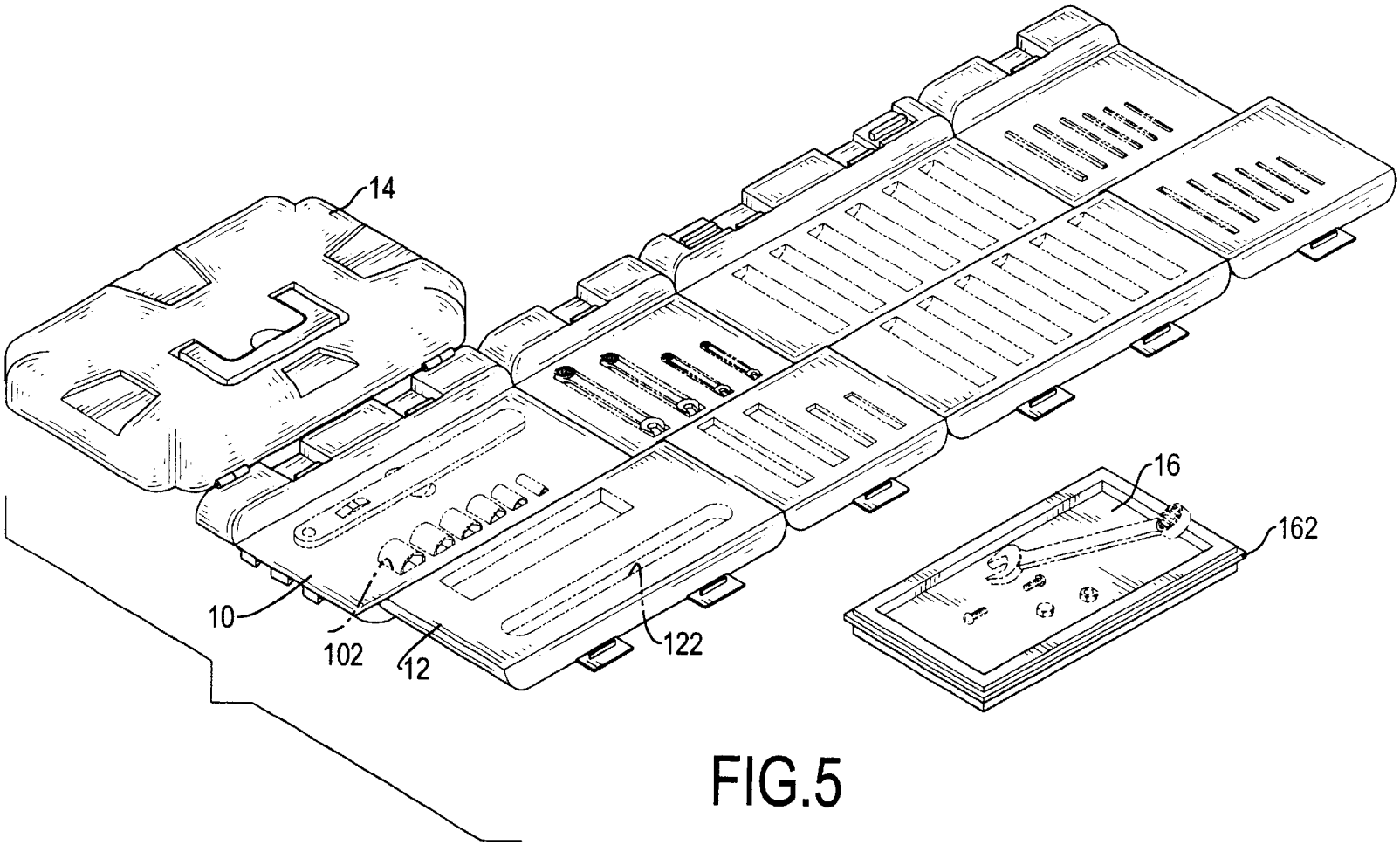
FIG. 5 is a perspective view of the tool case in FIG. 1 showing that the tool case is in an expanded condition.

When the pivotal pin (11) is removed from the pivotal holes, the connection relationship between the side plates (10) will be released. Consequently, the side plates (10) can be opened out to an expanded condition as shown in FIG. 5. Accordingly, the tool case can be put on an object with a flat surface, such the ground or a table. Because the recesses (102,122) for storing tools are all defined in the facing sides of the side plates (10) and the side covers (12), the sides with recesses (102,122) of the side plates (10) and the side covers (10) will face upward when the tool case is expanded. This is convenient for a user to take out and to use the tools stored in the recesses (102,122) in the side plates (10) and the side covers (12). To use the tool case is convenient and versatile.

The bottom plate (16) is detachably mounted on the side plates (10), such that the bottom plate (16) can be detached from side plates (10) when the tool case is expanded. With further reference to FIGS. 3 and 5, a lip (162) is formed around the bottom plate (16), and each respective side plate (10) has a groove (106) defined in the inner side of the side plate (10) to receive the lip (162) on the bottom plate (16) in cooperation. When the side plates (10) are connected together, the lip (162) on the bottom plate (16) is received in the grooves (106) in the side plates (10). This can make the bottom plate (16) securely attach to the side plates (10). When the connection device between the side plates (10) is disengaged and the side plates (10) are expanded, the bottom plate (16) will automatically disengage from the grooves (106) in the side plates (10).

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A tool case comprising:

multiple side plates each having an outer side, an inner side and two ends respectively connecting with adjacent side plates to define a containing space with a top opening and a bottom opening between the inner sides of the side plates, and the outer side of each respective side plate having multiple recesses adapted for receiving tools;

a bottom plate attached to the-side plates to close the bottom opening of the containing space;

an upper cover pivotally attached to one of the side plates to close the containing space; and a side cover pivotally connected to each side plate and having an inner side facing the corresponding one of the side plates and having multiple recesses adapted to receive tools.

2. The tool case as claimed in claim 1 further comprising an engaging device mounted between the upper cover and one of the side plates away from the side plate on which the upper cover is mounted, wherein the engaging device comprises at least one knob formed on the side plate corresponding to the upper cover; and a first engaging tab extending from the upper cover and corresponding to each respective at least one knob to detachably engage with the corresponding one of the at least one knob.

3. The tool case as claimed in claim 2 further comprising a handle mounted on the: upper cover.

4. The tool case as claimed in claim 1 further comprising an engaging device mounted between each respective side plate and the corresponding one of the side covers, wherein the engaging device comprises at least one knob formed on the side plate; and a second engaging tab extending from the side cover and corresponding to each respective at least one knob to detachably engage with the corresponding one of the at least one knob.

5. The tool case as claimed in claim 1 further comprising a detachable connection device mounted between two of the side plates to make the side plates expandable, wherein the bottom plate is detachably mounted on the side plates.

6. The tool case as claimed in claim 5, wherein the connection device comprises:

at least one first pivotal block with a pivotal hole formed on one of the side plates;

at least one second pivotal block with a pivotal hole formed on an adjacent side plate; and a pivot pin detachably penetrating through the pivotal holes in the at least one first pivotal block and the at least one second pivotal block.

7. The tool case as claimed in claim 5, wherein the bottom plate has a lip formed around the bottom plate; and each respective side plate has a groove defined in the inner side of the side plate to receive the lip on the bottom plate in cooperation.

* * * * *